US009598809B2

(12) United States Patent
Davis

(10) Patent No.: US 9,598,809 B2
(45) Date of Patent: Mar. 21, 2017

(54) WASHING MACHINE APPLIANCE WITH A DAMPER

(71) Applicant: General Electric Company, Schenectady, NY (US)

(72) Inventor: Paul Owen Davis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 217 days.

(21) Appl. No.: 14/282,258

(22) Filed: May 20, 2014

(65) Prior Publication Data

US 2015/0337478 A1 Nov. 26, 2015

(51) Int. Cl.
*D06F 37/24* (2006.01)
*D06F 23/04* (2006.01)

(52) U.S. Cl.
CPC ..... *D06F 37/24* (2013.01); *D06F 23/04* (2013.01)

(58) Field of Classification Search
CPC ..... D06F 37/24; D06F 23/04
USPC ..... 68/23.1
See application file for complete search history.

(56) References Cited

U.S. PATENT DOCUMENTS 7,549,519 B2 6/2009 Atwater et al.
2011/0247372 A1* 10/2011 Miller ..... D06F 37/12 68/13 R

FOREIGN PATENT DOCUMENTS

GB 2279968 A 1/1995
JP 2868688 B2 3/1999

* cited by examiner

*Primary Examiner* — Michael Barr
*Assistant Examiner* — Rita Adhlakha
(74) *Attorney, Agent, or Firm* — Dority & Manning, P.A.

(57) ABSTRACT

A washing machine appliance is provided. The washing machine appliance includes a cabinet and a tub disposed within the cabinet. The washing machine appliance also includes features for variably damping motion of the tub relative to the cabinet, such as a damper with a first, rigid piston and a second, compliant piston slidably received within a cylinder of the damper.

9 Claims, 6 Drawing Sheets

WASHING MACHINE APPLIANCE WITH A DAMPER

FIELD OF THE INVENTION

The present subject matter relates generally to washing machine appliances, such as vertical axis washing machine appliances, and dampers for washing machine appliances.

BACKGROUND OF THE INVENTION

Washing machine appliances generally include a cabinet which receives a tub for containing wash and rinse water. A wash basket is rotatably mounted within the wash tub. A drive assembly is coupled to the wash tub and configured to rotate the wash basket within the wash tub in order to cleanse articles within the wash basket. Upon completion of a wash cycle, a pump assembly can be used to rinse and drain soiled water to a draining system.

Washing machine appliances include vertical axis washing machine appliances and horizontal axis washing machine appliances, where "vertical axis" and "horizontal axis" refer to the axis of rotation of the wash basket within the wash tub. Vertical axis washing machine appliances typically have the wash tub suspended in the cabinet with damping devices. Vertical axis washing machine appliances exhibit vibration harmonics and work in a wide range of rotational speeds. Vibration has been addressed through use of fixed friction damping devices, tuned to one condition that requires the greatest amount of friction. Fixed friction type damping devices, however, may poorly accommodate the wide range of mass, imbalance, and rotational speed seen in vertical axis washing machine appliances.

Accordingly, a need exists for a damping device with features for damping motion of a wash tub relative to a cabinet. In particular, a damping device for a washing machine appliance that includes features for varying a damping force generated by the damping device would be useful.

BRIEF DESCRIPTION OF THE INVENTION

The present subject matter provides a washing machine appliance. The washing machine appliance includes a cabinet and a tub disposed within the cabinet. The washing machine appliance also includes features for variably damping motion of the tub relative to the cabinet, such as a damper with a first, fixed piston and a second compliant piston slidably received within a cylinder of the damper. Additional aspects and advantages of the invention will be set forth in part in the following description, or may be apparent from the description, or may be learned through practice of the invention.

In a first exemplary embodiment, a washing machine appliance is provided. The washing machine appliance includes a cabinet and a tub disposed within the cabinet. A damper includes a rod that extends between a first end portion and a second end portion. The rod is coupled to the cabinet at the first end portion of the rod. A cylinder is positioned adjacent the second end portion of the rod. The cylinder defining an axis of motion. A rigid piston is disposed within the cylinder such that the rigid piston is slidable along the axis of motion within the cylinder. The rigid piston is coupled to the rod at the second end portion of the rod. A compliant piston is disposed within the cylinder such that the compliant piston is slidable along the axis of motion within the cylinder. The compliant piston is coupled to the rod at the second end portion of the rod.

In a second exemplary embodiment, a washing machine appliance is provided. The washing machine appliance includes a cabinet and a tub disposed within the cabinet. A damper includes a rod extending between a first end portion and a second end portion. The rod is coupled to the cabinet at the first end portion of the rod. A cylinder is positioned adjacent the second end portion of the rod. The cylinder defines an axis of motion. A first piston is disposed within the cylinder such that the first piston is slidable along the axis of motion within the cylinder. The first piston is coupled to the rod at the second end portion of the rod. A second piston is disposed within the cylinder such that the second piston is slidable along the axis of motion within the cylinder. The second piston is positioned adjacent the second end portion of the rod. A compliant member extends between the first and second pistons.

In a third exemplary embodiment, a washing machine appliance is provided. The washing machine appliance includes a cabinet and a tub disposed within the cabinet. The washing machine appliance also includes means for variably damping motion of the tub relative to the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
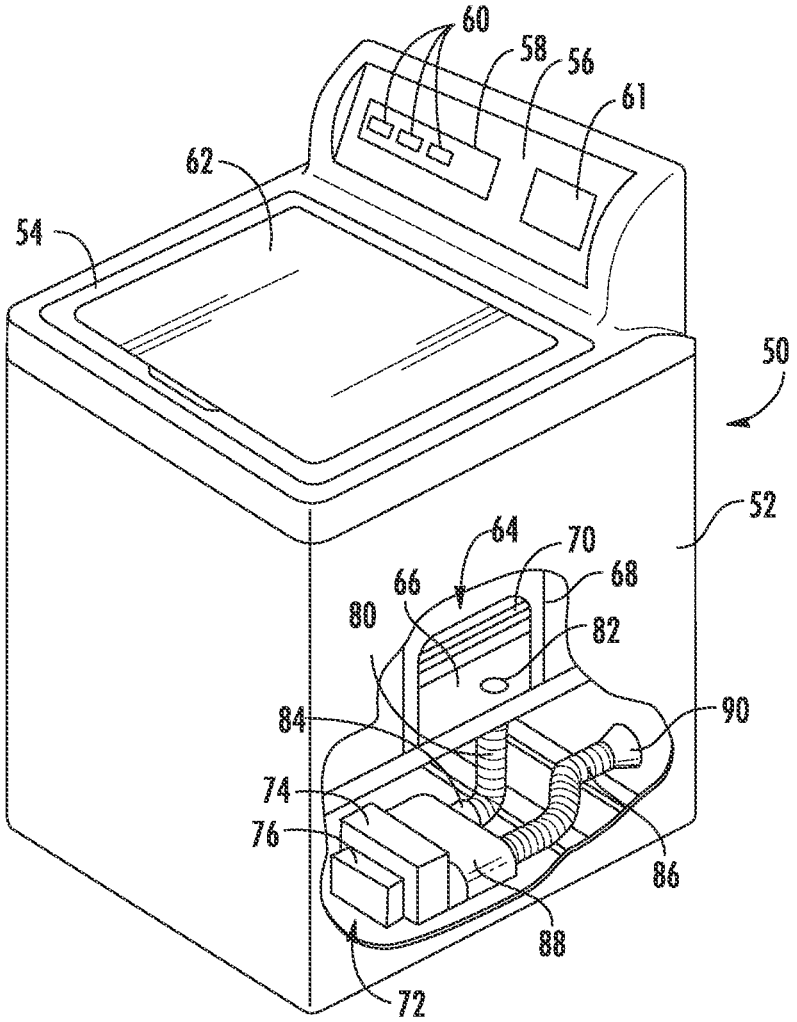
FIG. 1 provides perspective view of a washing machine appliance according to an exemplary embodiment of the present subject matter with a portion of a cabinet of the exemplary washing machine appliance shown broken away in order to reveal certain interior components of the exemplary washing machine appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view partially broken away of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
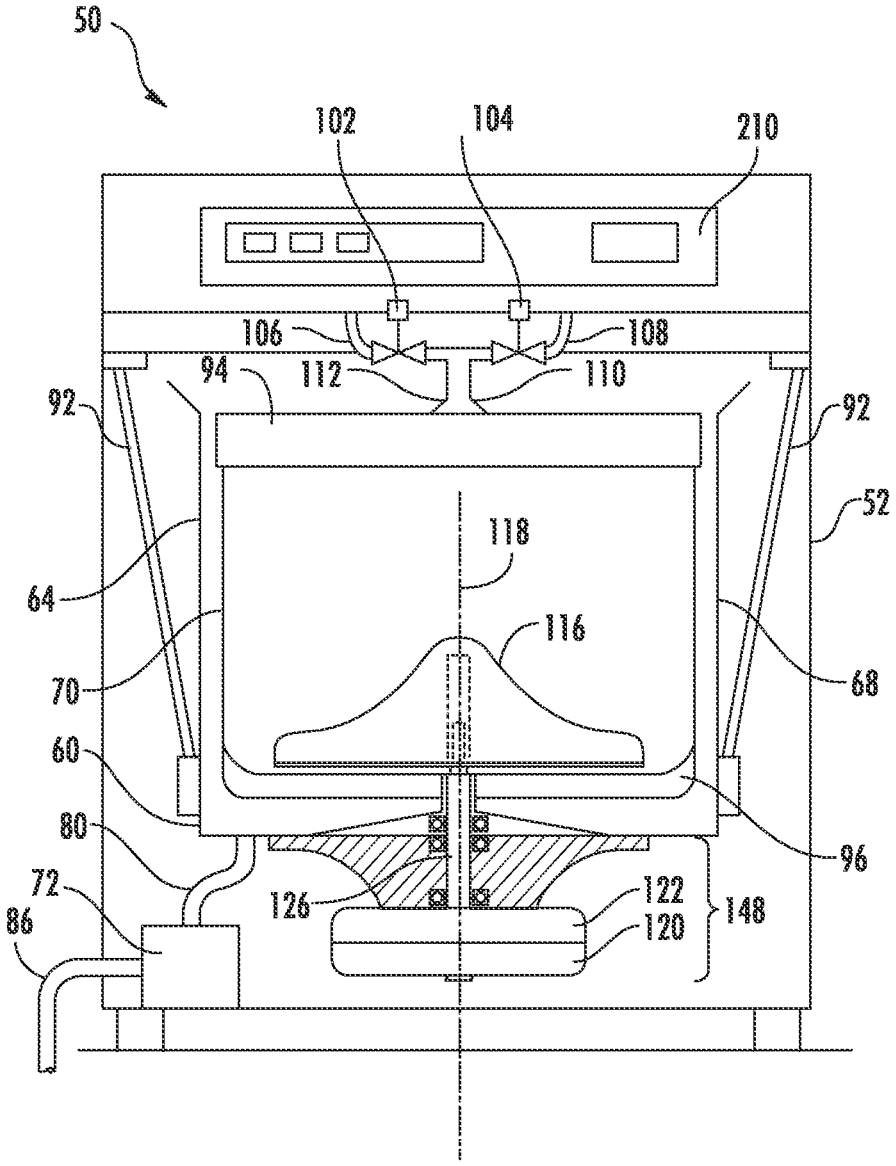
FIG. 2 provides a front elevation schematic view of certain components of the exemplary washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

An agitation element 116, such as a vane agitator, impeller, auger, or oscillatory basket mechanism, or some combination thereof is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148.

Basket 70, tub 64, and machine drive system 148 are supported by a vibration dampening suspension system 92. The dampening suspension system 92 can include a plurality of damping elements, such as piston-cylinder damping elements, coupled to the wash tub 64. The dampening suspension system 92 can include other elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

Dampening suspension system 92 operates to dampen dynamic motion as the wash basket 70 rotates within the wash basket 64. The dampening suspension system 92 has various natural operating frequencies of the dynamic system. These natural operating frequencies are referred to as the modes of suspension for the washing machine. For instance, the first mode of suspension for the washing machine occurs when the dynamic system including the wash basket 70, tub 64, and dampening suspension system 92 are operating at the first resonant or natural frequency of the dynamic system.

Operation of washing machine appliance 50 is controlled by a controller 210 which is operatively coupled to the user interface input located on washing machine backsplash 56 (shown in FIG. 1) for user manipulation to select washing machine cycles and features. In response to user manipulation of the user interface input, controller 210 operates the various components of washing machine appliance 50 to execute selected machine cycles and features.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed and portions of the cycle may be repeated, including the agitation phase, depending on the particulars of the wash cycle selected by a user.

Figure 3:
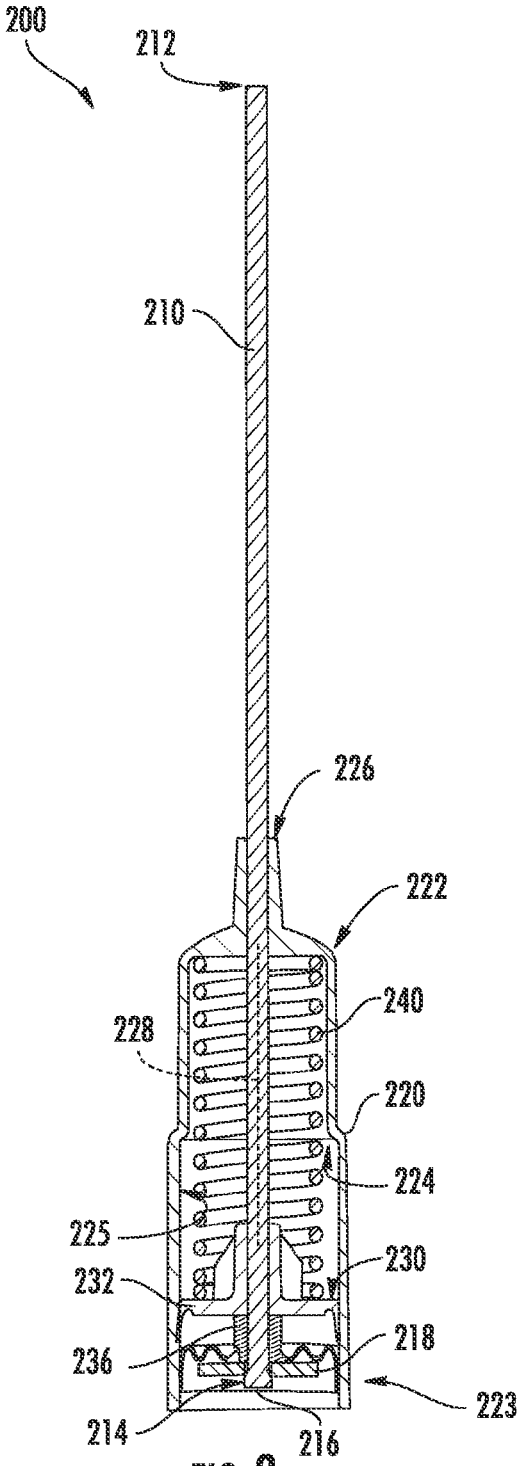
FIG. 3 provides a section view of a damper according to an exemplary embodiment of the present subject matter.
Figure 4:
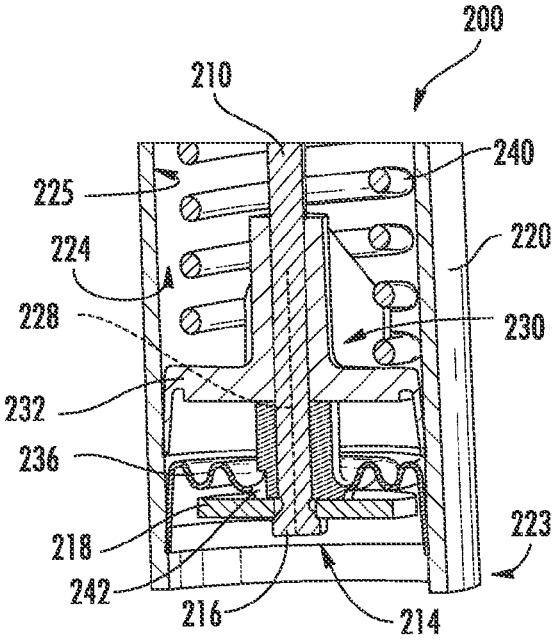
FIG. 4 provides a partial section view of the exemplary damper of FIG. 3.

FIG. 3 provides section view of a damper 200 according to an exemplary embodiment of the present subject matter. FIG. 4 provides a partial section view of damper 200. Damper 200 may be used in any suitable washing machine appliance. For example, damper 200 may be used in washing machine appliance 50 (FIG. 1) as part of dampening suspension system 92 in order to couple tub 64 to cabinet 52 and dampen motion of tub 64 relative to cabinet 52.

As may be seen in FIG. 3, damper 200 includes a shaft or rod 210. Rod 210 extends, e.g., linearly, between a first end portion 212 and a second end portion 214. First end portion 212 of rod 210 may be, e.g., rotatably or pivotally, mounted or otherwise coupled to a cabinet of an associated washing machine appliance, such as cabinet 52 of washing machine appliance 50. A swage 216 may be formed on rod 210 at second end portion 214 of rod 210. Swage 216 hinders or prevents a support plate 218 from sliding off rod 210. In turn, support plate 218 supports or bears a piston assembly 230 on rod 210. Thus, swage 216 and support plate 218 assist with mounting piston assembly 230 on rod 210.

Damper 200 also include a casing or cylinder 220 positioned at or adjacent second end portion 214 of rod 210. Cylinder 220 may be mounted or fixed to tub 64 of washing machine appliance 50. Cylinder 220 extends between a first end portion 222 and a second end portion 223. Cylinder 220 also defines an interior volume 224. Piston assembly 230 is disposed within interior volume 224 of cylinder 220. Rod 210 also extends through cylinder 220, e.g., at first end portion 222 of cylinder 220. For example, cylinder 220 defines a passage 226 at first end portion 222 of cylinder 220, and rod 210 may extend through passage 226 of cylinder 220 into interior volume 224 of cylinder 220. Cylinder 220 also defines an axis of motion 228. Piston assembly 230 is movable or slidable along the axis of motion 228 within cylinder 220.

A spring 240 or other biasing mechanism extends between cylinder 220 and piston assembly 230 within interior volume 224 of cylinder 220. Spring 240 biases or urges piston assembly 230 towards the second end portion 223 of cylinder 220. In addition, spring 240 provides tub 64 rocking motion degrees of freedom, supports tub 64 within cabinet 52 and assists with coupling cylinder 220 to rod 210.

Piston assembly 230 may compress gases, such as air, within interior volume 224 of cylinder 220 during motion of tub 64 relative to cabinet 52. In addition, friction between components of piston assembly 230 and an inner surface 225 of cylinder 220 provides damping of the motion of tub 64 relative to cabinet 52 during motion of piston assembly 230 within cylinder 220. Piston assembly 230 is discussed in greater detail below.

Figure 5:
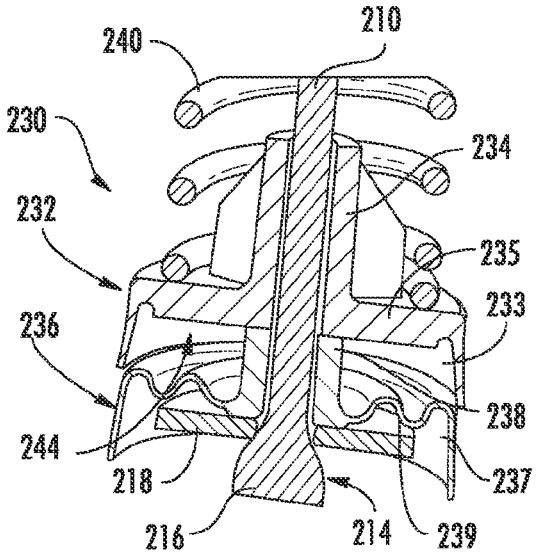
FIG. 5 provides a partial section view of a piston assembly of the exemplary damper of FIG. 3.

FIG. 5 provides a partial section view of piston assembly 230 of damper 200. As may be seen in FIG. 5, piston assembly 230 includes a rigid piston 232 and a compliant piston 236. Rigid piston 232 is received within cylinder 220. In particular, rigid piston 232 is movable or slidable along the axis of motion 228 within cylinder 220. Rigid piston 232 is also coupled to rod 210, e.g., at or adjacent second end portion 214 of rod 210. Complaint piston 236 is also received within cylinder 220. In particular, compliant piston 236 is movable or slidable along the axis of motion 228 within cylinder 220. Complaint piston 236 is coupled to rod 210, e.g., at or adjacent second end portion 214 of rod 210. In particular, compliant piston 236 may be positioned between second end portion 214 of rod 210 and rigid piston 232.

Rigid piston 232 includes a skirt 233, a spring guide and center support 234 and a spring seat 235. Skirt 233 of rigid piston 232 is positioned such that skirt 233 contacts inner surface 225 of cylinder 220. Thus, skirt 233 of rigid piston 232 may slide on inner surface 225 of cylinder 220 during motion of piston assembly 230. Center support 234 of rigid piston 232 is received or positioned on rod 210. In particular, center support 234 of rigid piston 232 may be coupled to or mounted on rod 210 such that center support 234 of rigid piston 232 is fixed to rod 210 or is slidable on rod 210. Spring seat 235 extends between skirt 233 of rigid piston 232 and center support 234 of rigid piston 232. In particular, spring seat 235 rigidly couples skirt 233 of rigid piston 232 to center support 234 of rigid piston 232, e.g., such that any motion of center support 234 of rigid piston 232 along the axis of motion 228 is transferred to skirt 233 of rigid piston 232 via spring seat 235.

Compliant piston 236 includes a skirt 237, a spring guide and center support 238 and an undulate disc or bellows spring 239. Skirt 237 of compliant piston 236 is positioned such that skirt 237 of compliant piston 236 contacts inner surface 225 of cylinder 220. Thus, skirt 237 of compliant piston 236 may slide on inner surface 225 of cylinder 220 during motion of piston assembly 230. Center support 238 of compliant piston 236 is received or positioned on rod 210. In particular, center support 238 of compliant piston 236 may be coupled to or mounted on rod 210 such that center support 238 of compliant piston 236 is fixed to rod 210 or is slidable on rod 210. Center support 234 of rigid piston 232 may also contact center support 238 of compliant piston 236. In particular, center support 238 of compliant piston 236 may extend between support plate 218 and center support 234 of rigid piston 232. Bellows spring 239 extends between skirt 237 of compliant piston 236 and center support 238 of compliant piston 236. In particular, bellows spring 239 compliantly couples skirt 237 of compliant piston 236 to center support 238 of compliant piston 236, e.g., such that center support 238 of compliant piston 236 may move along the axis of motion 228 relative to skirt 237 of compliant piston 236. Thus, bellows spring 239 is configured to permit motion of center support 238 of compliant piston 236 on the axis of motion 228 relative to skirt 237 of the compliant piston 236.

As discussed above, damper 200 may dampen motion of tub 64 relative to cabinet 52. For example, piston assembly 230 may be compressed within interior volume 224 of cylinder 220 in order to produce a damping force. Rigid piston 232 and compliant piston 236 assist with varying the damping force generated by damper 200. For example, during small motions of tub 64 relative to cabinet 52, skirt 233 of rigid piston 232 moves along the axis of motion 228 within cylinder 220 and skirt 237 of compliant piston 236 remains static or fixed within cylinder 220. Thus, skirt 233 of rigid piston 232 moves within cylinder 220 relative to skirt 237 of compliant piston 236 during small motions of tub 64 relative to cabinet 52. In particular, skirt 233 of rigid piston 232 may move by less than about eight hundredths of an inch relative to skirt 237 compliant piston 236 during small motions of tub 64 relative to cabinet 52. Conversely, during large motions of tub 64 relative to cabinet 52, both skirt 233 of rigid piston 232 and skirt 237 of compliant piston 236 move along the axis of motion 228 within cylinder 220. In such a manner, damper 200 may provide variable damping for movement of tub 64 relative to cabinet 52. In particular, damper 200 generates less damping force at small amplitudes due to only rigid piston 232 moving along the axis of motion 228 within cylinder 220 while damper 200 generates more damping force at large amplitudes due to both rigid piston 232 and compliant piston 236 moving along the axis of motion 228 within cylinder 220.

Figure 6:
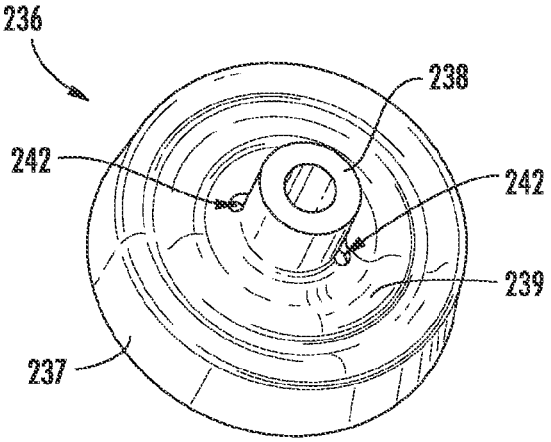
FIG. 6 provides a perspective view of a compliant piston of the exemplary damper of FIG. 3.

FIG. 6 provides a perspective view of compliant piston 236 of damper 200. As may be seen in FIG. 6, compliant piston 236 defines a plurality of conduits 242. Conduits 242 extend through compliant piston 236 in order to vent a gap 244 (FIG. 5) between compliant piston 236 and rigid piston 232. Thus, air or other fluid may flow through conduits 242 out of gap 244 rather than being compressed between compliant piston 236 and rigid piston 232 during movement of piston assembly 230 and by venting the air the effect of compressing this air on the motion of compliant piston 236 is avoided or limited.

Figure 7:
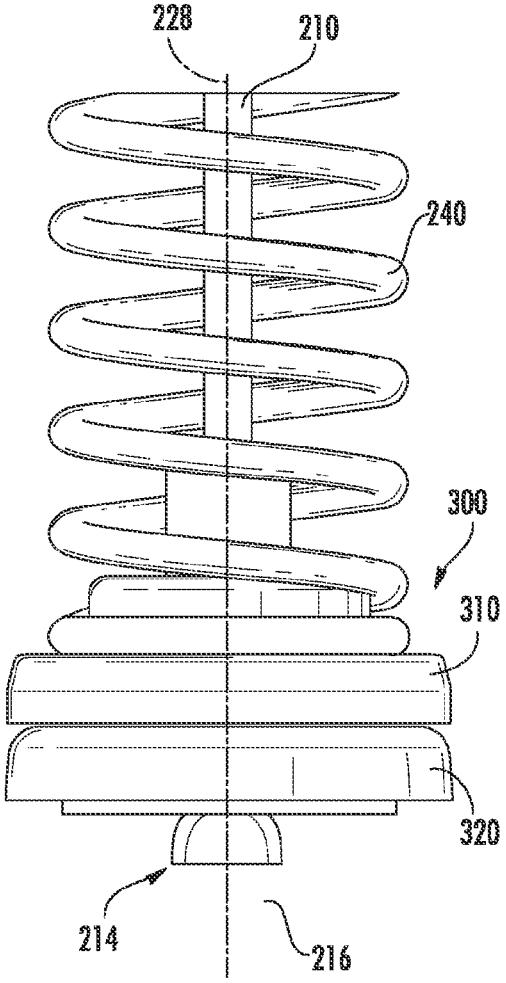
FIG. 7 provides a partial elevation view of a piston assembly according to an exemplary embodiment of the present subject matter.
Figure 8:
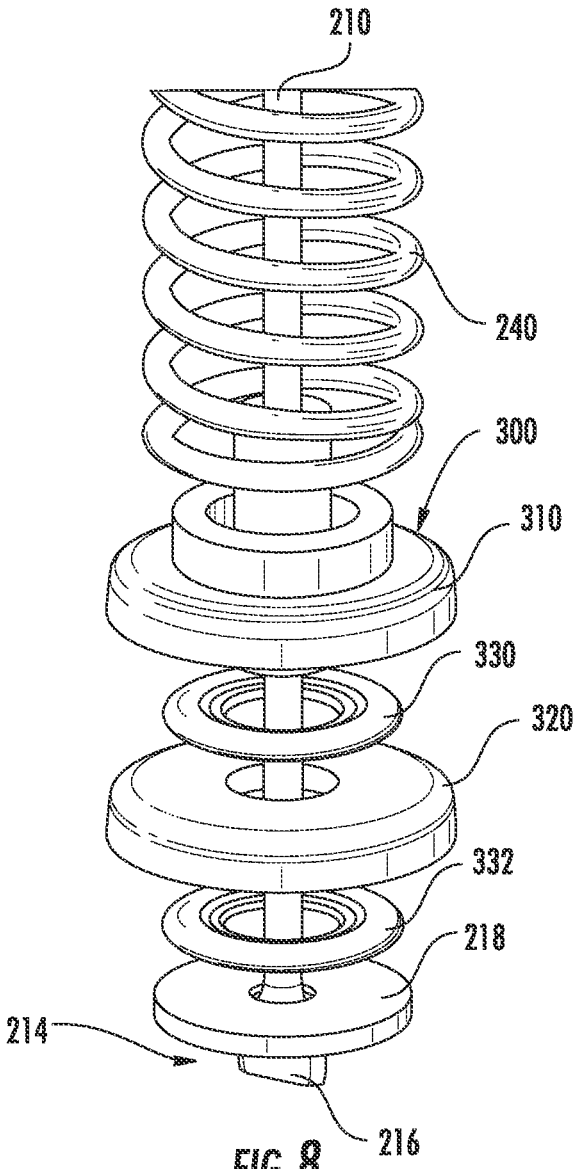
FIG. 8 provides an exploded view of the exemplary piston assembly of FIG. 7.

FIG. 7 provides a partial elevation view of a piston assembly 300 according to an exemplary embodiment of the present subject matter. FIG. 8 provides an exploded view of piston assembly 300. Piston assembly 300 may be used in any suitable damper. For example, piston assembly 300 may be used in damper 200 (FIG. 3) as piston assembly 230. Piston assembly 300 includes similar features and components as piston assembly 230 and may be constructed in a similar manner. Piston assembly 300 also includes features for assisting with varying a damping force generated by damper 200, e.g., in a similar manner to piston assembly 230.

As may be seen in FIGS. 7 and 8, piston assembly 300 may be mounted to rod 210. In particular, piston assembly 300 includes a first piston 310 and a second piston 320. First piston 310 may be disposed within cylinder 220 such that first piston 310 is slidable along the axis of motion 228 within cylinder 220. First piston 310 is also coupled to rod 210, e.g., at or adjacent second end portion 214 of rod 210. Second piston 320 may also be disposed within cylinder 220 such that second piston 320 is slidable along the axis of motion 228 within cylinder 220. Second piston 320 is positioned at or adjacent second end portion 214 of rod 210.

Figure 9:
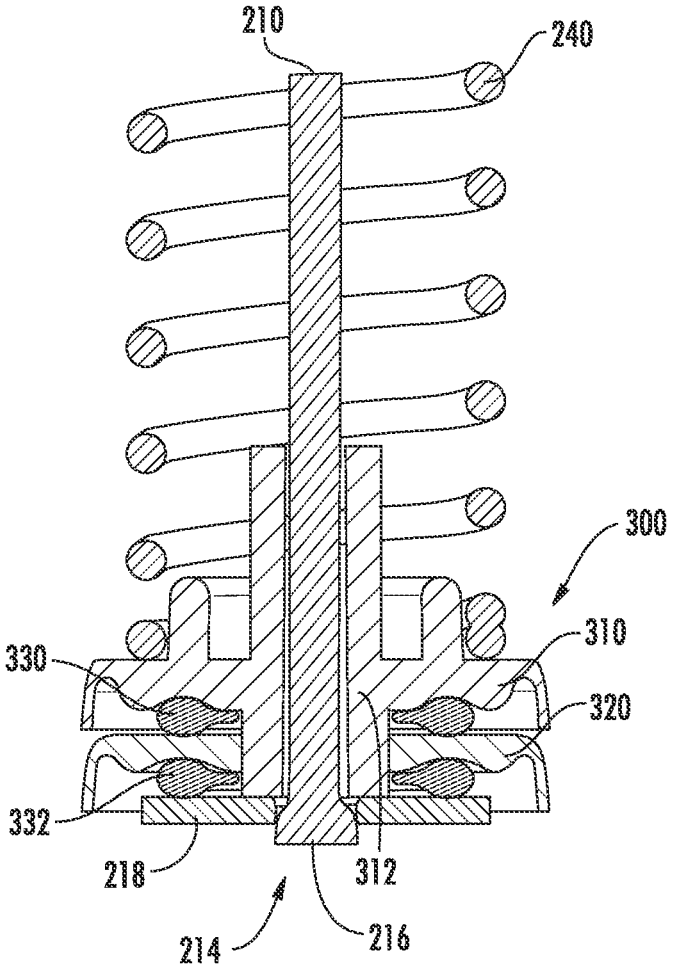
FIG. 9 provides section view of the exemplary piston assembly of FIG. 7.

FIG. 9 provides section view of piston assembly 300. As may be seen in FIG. 9, a compliant member 330 extends between first and second pistons 310, 320. Compliant member 330 may be any suitable elastically deformable member. For example, compliant member 330 may be an elastic washer (such as a foam disk or washer) or a metal spring (such as an arrangement of wave springs).

Compliant member 330 is elastically deformable in order to permit motion of first piston 310 on the axis of motion 228 relative to second piston 320. For example, piston assembly 300 may be compressed within interior volume 224 of cylinder 220 in order to produce a damping force. During small motions of tub 64 relative to cabinet 52, only first piston 310 moves along the axis of motion 228 within cylinder 220 and second piston 320 remains static or fixed within cylinder 220. Conversely, during large motions of tub 64 relative to cabinet 52, both first piston 310 and second piston 320 move along the axis of motion 228 within cylinder 220. Compliant member 330 may permit such motion of first piston 310 relative to second piston 320.

Piston assembly 300 also includes an additional compliant member 332. Additional compliant member 332 extends between support plate 218 and second piston 320. Additional compliant member 332 assists with permitting motion of second piston 320 relative to support plate 218, e.g., by elastically deforming. A center support 312 of first piston 310 may also contact support plate 218 in order to couple first piston 310 to support plate 218.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a tub disposed within the cabinet; and a damper comprising a rod extending between a first end portion and a second end portion, the rod coupled to the cabinet at the first end portion of the rod;

a cylinder positioned adjacent the second end portion of the rod, the cylinder defining an axis of motion;

a rigid piston disposed within the cylinder such that the rigid piston is slidable along the axis of motion within the cylinder, the rigid piston comprising a center support positioned on the rod at the second end portion of the rod;

a compliant piston disposed within the cylinder such that the compliant piston is slidable along the axis of motion within the cylinder, the compliant piston comprising a center support positioned on the rod at the second end portion of the rod; and wherein the compliant piston comprises a skirt positioned on an inner surface of the cylinder and an undulate disc portion extending between the skirt of the compliant piston and the center support of the compliant piston, the undulate disc portion coupling the skirt of the compliant piston to the center support of the compliant piston.

2. The washing machine appliance of claim 1, wherein the undulate disc portion is configured to permit motion of the skirt of the compliant piston on the axis of motion relative to the center support of the compliant piston.

3. The washing machine appliance of claim 1, wherein the rigid piston comprises a skirt positioned on the inner surface of the cylinder and a spring seat extending between the skirt of the rigid piston and the center support of the rigid piston.

4. The washing machine appliance of claim 3, wherein the spring seat rigidly couples the skirt of the rigid piston to the center support of the rigid piston.

5. The washing machine appliance of claim 3, wherein the center support of the rigid piston contacts the center support of the compliant piston.

6. The washing machine appliance of claim 1, wherein the damper further comprises a spring disposed within the cylinder, the spring extending between the cylinder and the rigid piston.

7. The washing machine appliance of claim 1, wherein the cylinder extends between the first end portion and the second end portion, the rod extending through the cylinder at the first end portion of the cylinder, the rigid and compliant pistons positioned within the cylinder adjacent the second end portion of the cylinder.

8. The washing machine appliance of claim 1, wherein the compliant piston defines a conduit, the conduit of the compliant piston venting a gap between the compliant piston and the rigid piston.

9. The washing machine appliance of claim 1, wherein the compliant piston is positioned between the second end portion of the rod and the rigid piston.

* * * * *